United States Patent [19]

Saffer et al.

[11] 4,299,548

[45] Nov. 10, 1981

[54] TOY CASTING MACHINE

[75] Inventors: Gary M. Saffer, Torrance; Hubert A. Rich, Westminster; David N. Carman, Cerritos; Ferenc Fekete, Huntington Beach, all of Calif.

[73] Assignee: Mattel, Inc., Hawthorne, Calif.

[21] Appl. No.: 101,967

[22] Filed: Dec. 10, 1979

[51] Int. Cl.[3] ..... B29C 5/00

[52] U.S. Cl. ..... 425/173; 425/259; 425/447; 425/DIG. 57

[58] Field of Search ..... 425/DIG. 57, 259, 447, 425/173; 164/335

[56] References Cited

U.S. PATENT DOCUMENTS

| | | | |
|---|---|---|---|
| 3,590,749 | 7/1971 | Burns | 425/173 |
| 3,664,786 | 5/1972 | Devine | 425/173 |
| 3,690,367 | 9/1972 | Daniels | 164/335 |
| 4,159,732 | 7/1979 | Handkummer | 164/335 |
| 4,215,843 | 8/1980 | Gay et al. | 425/447 |

*Primary Examiner*—James H. Derrington
*Attorney, Agent, or Firm*—Reagin & King

[57] ABSTRACT

A toy casting machine including a base which has mounted thereon a crucible into which plastic materials may be placed for melting. The crucible is rotatably mounted to a sidewall and may be duped by an actuating mechanism which also moves a predesigned mold into position below the crucible. The crucible and machinery are entirely covered by transparent material to allow viewing the operation and to protect a child operating the machine. An isolating loading apparatus is provided to allow the machine to be loaded with raw material and molds without endangering the operator.

5 Claims, 4 Drawing Figures

TOY CASTING MACHINE

BACKGROUND OF THE INVENTION

The background of the invention will be discussed in two parts:

FIELD OF THE INVENTION

This invention relates to toys and, more particularly, to a machine for use by children in casting plastic toys.

DESCRIPTION OF THE PRIOR ART

There have been a myriad of toys developed over the years for use by children. Many of these toys have become classics and have been reproduced again and again. Those toys which have continued to entrance children over long periods have certain common characteristics. Most important of these characteristics is that they provide a substantial amount of play value for the child. The play value of the toy may be enhanced by making the toy exciting, by causing it to provide a learning experience, and by other means. The lack of play value has caused substantial problems for prior art toys.

Other characteristic of toys which cause them to remain in vogue for long periods are that they are easy for a child to use, durable, safe for a child to use, and inexpensive.

It is an object of the present invention to provide a new and improved machine by which a child may cast plastic and other materials into particular desired forms.

It is another object of the present invention to provide a durable toy machine which allows children to make their own high quality toys.

Another object of this invention is to provide an expecially safe toy casting machine.

Yet another object of this invention is to provide an inexpensive machine which may be used for casting children's toys and the like.

SUMMARY OF THE INVENTION

The foregoing and other objects of the invention are accomplished by a toy casting machine including a base which has mounted thereon a crucible into which plastic, wax, or other low melting temperature materials may be placed for melting. The crucible is rotatably mounted to a sidewall and may be dumped by an actuating mechanism which also moves a predesigned mold into position below the crucible. The crucible and machinery are entirely covered by transparent material to enhance the play value and protect a child operating the machine. Unique means are provided to allow the machine to be loaded with raw material and molds without endangering the operator.

Other objects, features, and advantages of the invention will become apparent from the reading of the specification taken in conjunction with the drawings in which like reference numerals refer to like elements in the several views.

DESCRIPTION OF THE PREFERRED EMBODIMENT

Figure 1:
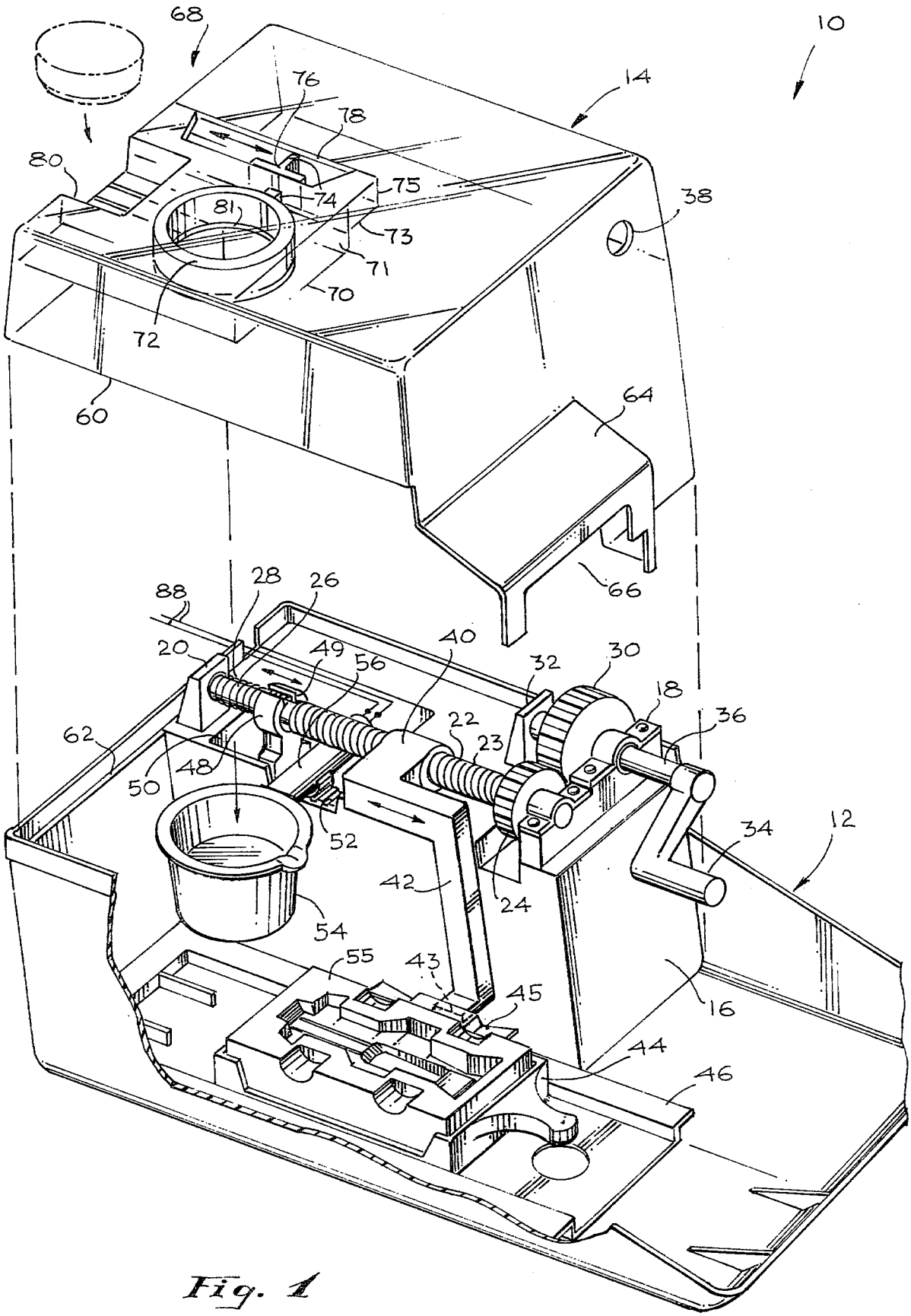
FIG. 1 is a perspective view (with portions thereof cut away) of a toy casting machine constructed in accordance with the invention.

Referring now to the drawings, and more particularly, to FIG. 1, there is shown a perspective view of a toy casting machine 10 constructed in accordance with the invention. In the perspective view shown in FIG. 1, the machine 10 has been separated into its two major parts, a base 12 and a cover 14. These two portions fit together and may be tightly joined by well known means so that the internal operating machinery is tightly enclosed as will be described hereinafter.

The base 12 is generally rectangular in shape when viewed from above and has a platform 16 projecting upwardly to which are affixed various of the operating elements of the machine 10. Projecting upwardly from the platform 16 are a first mount 18 and a second mount 20. Rotatably mounted by the two mounts 18 and 20 is an axle 22 carrying a gear 24 tightly fixed thereto. The axle 22 carries a leadscrew 23 along its axis between the gear 24 and a smaller portion 26 to the left thereof. A spring 28 is mounted to surround the smaller portion 26 of the axle 22. A second gear 30 is rotatably suppported by the mount 18 and a third mount 32 to mesh with the gear 24. A handle 34 projects from the axle 36 for rotating the gear 30.

A follower 40 having a screw thread which mates with the thread of the lead screw 23 is positioned to be moved along the axis of the axle 22 by the rotation of gear 24. The follower carries an inverted L-shaped arm 42 which extends downwardly along the side of the platform 16 and has an extension 43. The extension 43 is adapted to mate with an arrangement at the side of a mold carrier 44 to move that carrier 44 along the bottom of the base 12. The mold carrier 44 rests in a slide 46 which is used to remove the mold carrier from the interior of the machine 10 when the cover 14 is in position.

Loosely positioned around the portion 26 of the axle 22 is an L-shaped member 48 which slides in a rectangular cavity 50 in the upper surface of the platform 16. The upper surface of the horizontal leg of the L-shaped member 48 carries a gear facing 52. The cylindrical aperture in the member 48 has a lip 49 which supports the right end of the spring 28. The member 48 is impelled by the spring 28 surrounding the portion 24 so that it rests approximately in the position shown in FIG. 1. A crucible 54 is rotatably mounted to the sidewall of the platform 16 by a cylindrical arm 56 which projects through the sidewall and into the cavity 50. The arm 56 carries on its lower surface a section of a spur gear 57 (see FIG. 4) which meshes with the gear facing 52 on the upper surface of the horizontal portion of the L-shaped member 48.

Figure 2:
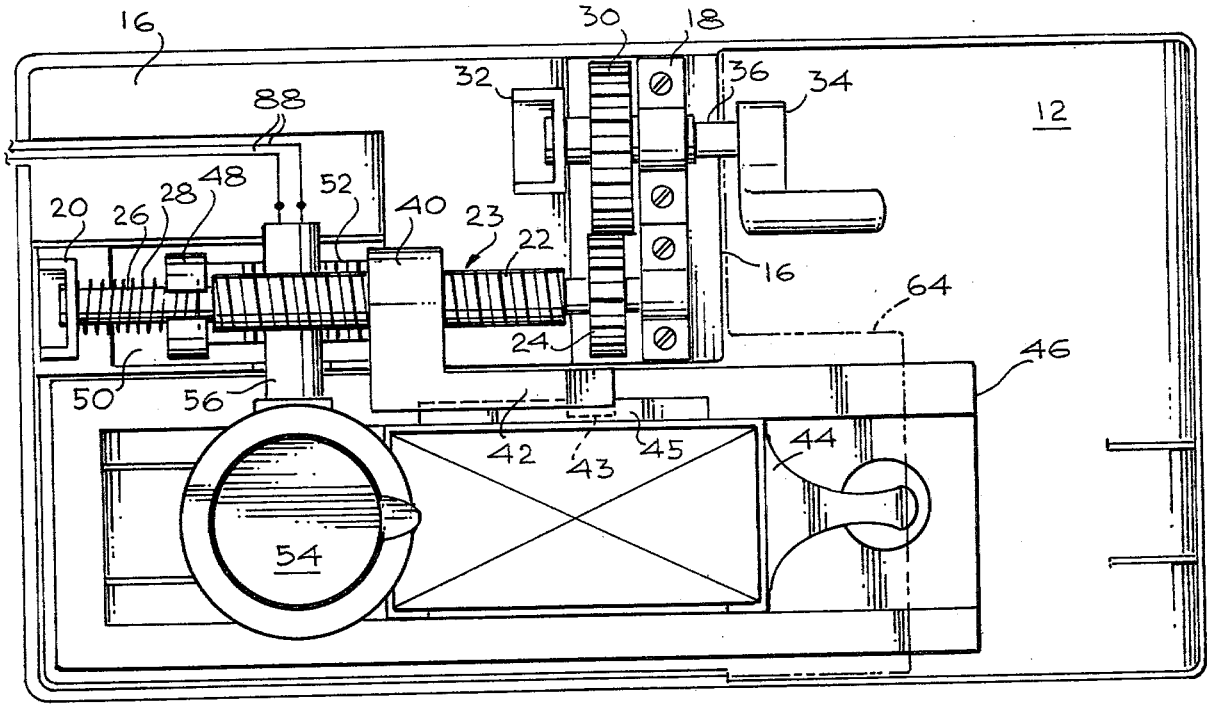
FIG. 2 is a top view of the internal actuating mechanism of the invention shown in FIG. 1.
Figure 3:
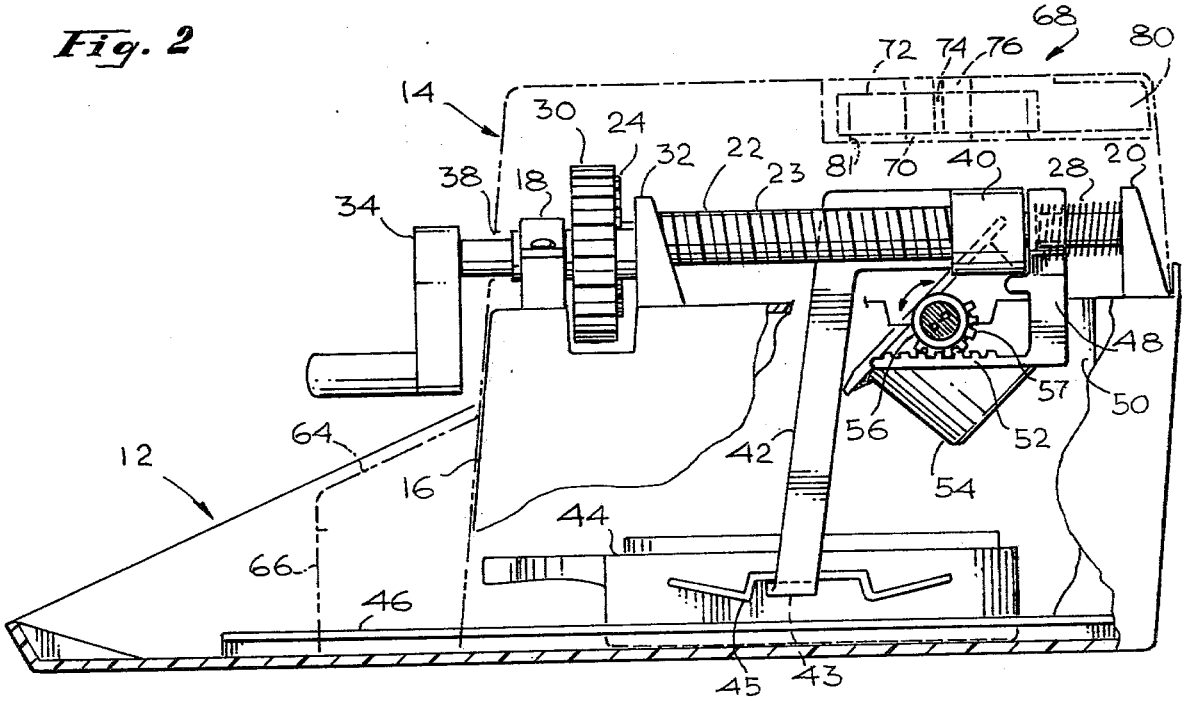
FIG. 3 is a side view of the internal actuating mechanism of the invention shown in FIG. 1; and, FIG. 4 is an exploded side view showing the details of construction of the crucible used in the invention shown in FIG. 1.

As may be seen in FIGS. 1, 2, and 3, as the handle 34 is rotated, the gears 30 and 24 and the axle 22 revolve. As the axle 22 revolves, the follower 40 is driven either to the left or to the right. Presuming that the handle 34 is rotated in the sense to drive the follower 40 to the left, the follower 40 pulls with it the arm 42 which urges a mold carrier 44 into a position under the curcible 54 determined by the end of the leadscrew 23 on the axle 22. As may be seen in FIG. 3, the extension 43 of the arm 42 fits into an upwardly projecting notch in a side rail 45 on the carrier 44 so that motion of the arm 42 will move the carrier 44 to the left or right. As the follower 40 abutts against the L-shaped member 48, it drives the member 48 to the left causing the gear facing 52 to move to the left. As the gear facing 52 moves to the left, it rotates the sector gear surface on arm 56 causing the arm 56 and the crucible 54, attached thereto, to rotate. As the crucible 54 rotates, any liquid therein will be caused to spill into a mold positioned in the mold carrier 44 which has by now assumed the correct position under the crucible 54.

As is obvious, the interior of the machine 10 will have portions which are quite hot and might burn a person operating the machine 10. Furthermore, the interior of the machine contains various gears and other parts which for the sake of safety might be better closed to access by a child. The cover 14 provides such protection in the machine 10 of this invention. As may be seen in FIG. 1, the cover 14 fits tightly down over and covers all of the internal machinery including the gearing, and crucible 54, and the mold so that that machinery is isolated from its operator. The cover 10, in a preferred embodiment, is made of clear plastic material so that the operation of the machinery may be viewed thereby making the procedure more exciting and providing a substantial learning experience. As is obvious, the cover 14 has a lower lip 60 which fits into a recess 62 extending around the interior of the upper periphery of the base 12. The cover 14 also has a projecting forward portion 64 which covers the mold carrier 44 and the slide 46 while they are in the machine 10. An aperture 66 in the front of the portion 64 allows the slide 46, the mold carrier 44, and a mold to be inserted into machine 10 without allowing an operator's hand to reach the interior of the machine.

The upper surface of the cover 14 also includes a unique loading mechanism 68 which in the preferred embodiment includes a chamber having a clear plastic platform 70 upon which a ring 72 of plastic material is positioned to slide. The platform 70 is fixed to the side of the cover 14 and by a clear wall 71 to a second clear platform 73 supported by a wall 75 to the top of the cover 14. The ring 72 has an arm 74 projecting therefrom. The arm carries a cross member 76 which at its upper end projects through and is guided by the forward edge of an aperture 78 in the upper surface of the cover 14. Another aperture 80 in cover 14 allows the insertion of a plug of plastic material into the interior of the ring 72 when it is moved to the far left end of the platform 70.

The movement of the ring 72 is accomplished by finger pressure upon the arm 74 through the aperture 78. Thus, a child may move the ring 72 to the left, place a plug of a plastic or wax material in the center of the ring 72, and advance that plug by moving the arm 74 and the ring 72 to the center of the platform 70. At this point directly above the crucible 54 a circular aperture 81 is cut in the platform 70 so that the plug will drop therethrough into the crucible 54. Consequently, a child or other operator may safely place plastic material into the interior of the machine 10 without exposing himself to the heat.

FIG. 2 is a top view showing the mechanism for advancing the follower 40 by means of the handle 34, the gears 30 and 24, and the leadscrew 23. FIG. 2 illustrates the position of the follower 40 as it approaches the L-shaped member 48 causing the arm 42 to move to the left as shown in the drawing and rotating the arm 56 so that the crucible 54 dumps the heated material into a mold 55 held by the mold carrier 44.

FIG. 3 is a side view showing the details of the arrangement by which the arm 42 joins the side of the mold carrier 44 so that the mold carrier 44 may be moved to the right as shown in the drawing. FIG. 3 also illustrates more clearly the operation by which the crucible 54 is rotated to dump its contents. In FIG. 3 the L-shaped member 48 is more clearly shown with its gear surface 52 meshing with the gear surface on the arm 56. FIG. 3 also illustrates that the L-shaped member 48 is urged to the left by the spring 28 when the follower 40 is withdrawn to the left after the dumping operation.

All of the parts of the invention shown in FIGS. 1, 2, and 3, other than the interior of the crucible 54, the spring 28, and the various electrical parts, may be constructed of sturdy plastic materials adapted to be easily molded and selected to withstand the temperatures involved. Consequently, the machine 10 of this invention is relatively inexpensive to manufacture and is not easily broken by a child operator. To enhance the machine play value, the various plastic materials may be selected of different colors so that the operation of the interior as viewed through the transparent cover will be especially exciting.

Of special importance is the fact that molds may be provided which are constructed by professional mold makers and recast in light plastic materials such as vinyl. This allows a child to use professionally formed molds so that quality products are produced through the use of the machine. It has been found that the machine operates well using different colored plugs of low melting-point microcrystalline wax. Using such a material, if toys molded therefrom are damaged, they may be broken into parts and recast in the same mold. Thus, the materials used in casting may be used over and over again.

Figure 4:
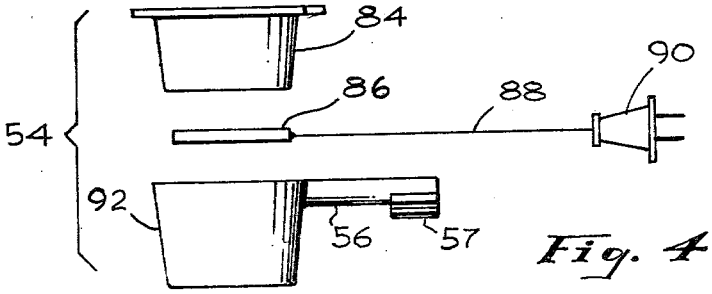

FIG. 4 is an exploded side view showing the construction of the crucible 54. The crucible 54 includes an interior portion 84 which may be constructed of a material such as aluminum which transfers heat rapidly. Fixed to the lower surface of the interior 84 is a heating element 86 well known in the art and available commercially as a Sierracin R.F. heater which maintains approximately 200° F. The heating element 86 is connected by wires 88 to a plug 90 external of the machine 10 for connecting to 60 cycle A.C. The wires 88 may be carried through the center of the arm 56 into the interior of the platform 16 so that they also are isolated from an operator of the machine. The wires 88 project out of the side of the base 12 where they connect to the plug 90. The interior 84 of the crucible 54 with the heating element 86 attached thereto is inserted into a plastic holder 92 connected to the arm 56. The interior 84 may be fixed to the holder 92 by various means including screws and the like so that it will not separate therefrom.

In operation, a plug of a plastic (or other material having a melting point below 200° F.) is placed in the ring 72, slid forward by the arm 74, and dropped into the crucible 54. The plastic is heated to melting in the crucible 54. The handle 34 is then turned to impel the mold carrier 44 with a mold to move in the slide 46 to a position under the crucible 54. As the handle 34 continues to turn, the liquid plastic pours from the crucible 54 into the mold. After cooling, the handle 34 is rotated in the opposite direction to move the carrier 44 to a position in which the mold may be removed through the aperture 66. The toy is then removed from the mold.

Although there has been disclosed a novel toy casting machine which provides a great deal of excitement for a child, allowing a child to make innovative, quality products easily, safely, and inexpensively, it is obvious that various changes might be made in the form of the machine while retaining the inventive concept. Thus, while there has been shown and described a preferred embodiment, it is to be understood that various other adaptations and modifications may be made which will fall within the spirit and scope of the invention.

What is claimed is:

1. A casting machine comprising:

a base;

a crucible rotatably affixed to the base;

a mold carrier slidably mounted to the base;

a means attached to the base, the mold carrier, and the crucible, for moving the mold carrier to a position under the crucible and for rotating the crucible to pour its contents into a mold; and means attached to the base for covering the crucible and mold carrier to isolate them from an operator while the casting operation is taking place, including a cover for the base having both means for inserting raw materials and means for inserting molds, without exposing an operator to the interior mechanism.

2. A casting machine comprising:

a base;

a crucible rotatably affixed to the base;

a mold carrier slidably mounted to the base; and a means attached to the base, the mold carrier, and the crucible, for moving the mold carrier to a position under the crucible and for rotating the crucible to pour its contents into a mold, the means including a lead screw, a follower moved by said lead screw and connectable to move said mold carrier, and a gear-toothed surface movable in response to the crucible and meshing with the surface.

3. A casting machine comprising:

a base;

a crucible rotatably affixed to the base;

a mold carrier slidably mounted to the base;

a means attached to the base, the mold carrier, and the crucible, for moving the mold carrier to a position under the crucible and for rotating the crucible to pour its contents into a mold; and means attached to the base for covering the crucible and mold carrier to isolate them from an operator while the casting operation is taking place, including a transparent cover for the base having both means for inserting raw materials and means for inserting molds, without exposing an operator to the interior mechanism, the means for inserting raw materials including a chamber affixed to the interior of the transparent cover having a base with an aperture therein positioned above the crucible, an aperture in the cover providing access to the chamber, said last-mentioned aperture being offset from the aperture in the base of the chamber, and means for conveying raw materials from the aperture in the cover to the aperture in the base of the chamber.

4. A casting machine as claimed in claim 3 in which the means for conveying raw material includes a ring slidable within the chamber and into which the raw material is placed, the ring having a handle for impelling the ring between the aperture in the cover and the aperture in the base of the chamber.

5. A casting machine as claimed in claim 1 in which the means for inserting molds comprises an aperture in the cover, a slide insertable through the aperture, and where the mold carrier is constructed to move in the slide.

* * * * *